US005946774A

United States Patent [19]

Ramsey et al.

[11] Patent Number: 5,946,774

[45] Date of Patent: Sep. 7, 1999

[54] HIDDEN DOOR HINGE

[76] Inventors: Edward Ramsey, 38265 E. Benton Rd., Temecula, Calif. 92592; Chris Vovos, 15505 Carrington Dr., La Mirada, Calif. 90638

[21] Appl. No.: 09/055,112

[22] Filed: Apr. 3, 1998

[51] Int. Cl.[6] ..... E05D 11/06

[52] U.S. Cl. ..... 16/357; 16/361; 16/355

[58] Field of Search ..... 16/357, 358, 359, 16/360, 361, 355, 356, 362, 364, 365, 366

[56] References Cited

U.S. PATENT DOCUMENTS

| | | | |
|---|---|---|---|
| 93,402 | 8/1869 | Blake | 16/355 |
| 819,098 | 5/1906 | Underhill | 16/357 |
| 1,486,371 | 3/1924 | Forbes | 16/355 |
| 1,648,781 | 11/1927 | Pepin | 16/355 |
| 2,056,805 | 10/1936 | Reichard | 16/355 |
| 2,203,041 | 6/1940 | Bobek | 16/357 |
| 2,322,286 | 6/1943 | Dumelin | 16/357 |
| 2,770,834 | 11/1956 | Jannace | 16/355 |

*Primary Examiner*—Chuck Y. Mah
*Attorney, Agent, or Firm*—Charles H. Thomas

[57] ABSTRACT

A hidden hinge mechanism is provided for mounting a door to a jamb in a door frame. The hinge mechanism may be formed of one or more pairs of body elements, sleeves, and a slide element. The body elements are formed as cylindrical barrels with arcuate cavities defined therewithin. These cavities have a circular curvature centered on a vertical axis of rotation that lies beyond the door and frame. The sleeve elements are hollow and also formed as arcuate structures that are mounted to move within the cavities in the cylindrical body elements in reciprocal fashion relative thereto. The sleeves move between closed positions retracted completely into the body elements and extended positions projecting therefrom. The arcuate slide has opposing ends that are respectively mounted to the sleeve elements in telescoping fashion. The slide moves between an extreme open position withdrawn from the sleeves and an extreme closed position encapsulated within them. The slide, the sleeves, and the cavities within the cylindrical barrels all have an arcuate configuration with a circular curvature centered on the axis of rotation of the door relative to the frame. There are two telescoping actions in the structure of the hidden door hinge. First, there is a telescoping action of the slide within the sleeves. There is a second telescoping action of the sleeves within the cavities in the hinge cylinder barrels. When the door is closed, the door mounting edge of the door lies flush against the door jamb and all of the components of the hinge are hidden from view.

12 Claims, 6 Drawing Sheets

HIDDEN DOOR HINGE

BACKGROUND OF THE INVENTION

1. Field of the Invention

The present invention relates to a hinge construction in which the hinge components are concealed from view when the door to which the hinge is attached is closed.

2. Description of the Prior Art

Hinges have been utilized to allow doors to be rotated relative to door frames for centuries. In conventional commercial building construction the predominant form of hinge construction employs a pair of hinge plates which each terminate in knuckles along one of their edges. The knuckles of the two hinge plates are interleaved with each other and define within their confines a cylindrical passage that receives a hinge pin. One of the hinge plates is attached to the edge of a door, while the other hinge plate is attached to the doorjamb or frame in alignment with the first hinge plate. Very typically two, three, or even more such hinges are provided to install a door in a door frame.

Conventional hinges of the type described have several significant disadvantages. When the hinge plates are attached to the door and to the frame to allow a door to open outwardly, there is a significant security risk. Unauthorized intrusion into the enclosure is quite easy even if the door is locked since the hinge knuckles and hinge pin are exposed. All that is required for an intruder to gain access to the enclosure is to drive the hinge pin out from its confines within the knuckles, thus allowing the door to separate from the jamb.

For this reason virtually all exterior doors of dwellings are hinged to open inwardly so that the hinge pins are not accessible from outside the building. However, inwardly opening doors are impractical for buildings such as garages, storage rooms, and other enclosures in which there is insufficient room on the inside for a door to swing inwardly. As a consequence, such structures are always vulnerable to unauthorized intrusion due to the construction of the hinges that hold the doors in place.

A further disadvantage of conventional hinge construction is that the exposed hinge elements must be fabricated of metal, usually steel, in order to be of sufficient durability to withstand long-term use. Iron or steel door hinges of this type, though strong enough to last for many years, are susceptible to rust. Even when hinges such as this are painted, the rust bleeds through and creates an unsightly discoloration not only on the hinge itself, but also on nearby door and frame surfaces.

Various hinge mechanisms have been designed to provide a hinge that is totally concealed from view when the door is closed. There are several advantages to the use of a concealed hinge. A hinge in which the components are totally concealed within the door frame and within the door when the door is closed offers no opportunity for tampering with the hinge from either side of the door. Thus, a hidden or concealed hinge offers significant security advantages over a conventional hinge having a hinge pin that passes through interleaved knuckles, particularly if the door opens outwardly.

A further advantage of concealing the component parts of a hinge is that even if there is some surface degradation to the hinge components, such as rust, the surface discolorations will be concealed from view when the door is closed. Moreover, since the hinge is concealed from view when the door is closed, it is also protected from the elements to a very significant extent. As a consequence, there will be less of a tendency for the hinge components to rust and discolor, since they are, to a large extent, protected within the structure of the door and door frame.

The biggest problem with past attempts to provide hidden or concealed hinges is that the construction of such devices has heretofore required such large cavities within a door and door frame that conventional concealed hinges cannot be utilized on standard doors if the doors are to fully open. To the contrary, conventional concealed hinges require cavities that are often wider than the standard one and three-eighths inch door that is used in most residential construction. As a consequence, the use of concealed hinges, as a practical matter, has only been possible with nonstandard doors of considerable thickness.

A further disadvantage of conventional concealed hinges is that the cavities that must be formed in the door and door frame require wide undercuts, and thus cannot be created using conventional cylindrical drill bits or convention saw-tooth attachments for drills, such as are utilized in forming cylindrical doorknob and lock bolt openings in doors. Quite to the contrary, the concealed hinges of the types that have been previously devised require arcuately-shaped cavities in the door and in the jamb that can only be created with considerable skill and time.

SUMMARY OF THE INVENTION

On primary object of the present invention is to provide a hidden or concealed hinge mechanism that can be utilized with standard doors having a thickness of as little as one and three-eighths inches. The unique construction and interaction of the components of the mechanism require a cavity of significantly smaller dimensions in the door in order to receive portions of the door hinge mechanism therewithin than has heretofore been possible.

A further object of the present invention is to provide a concealed door hinge which requires cavities in the door that avoid undercuts and which can be created using the standard drill bits and drill attachments that are widely utilized already in installing door hardware. Indeed, the shape of the cavity required in the door is a blind, cylindrical bore that can be easily created without the need for special tools.

A further object of the invention is to provide a concealed door hinge that is not vulnerable to tampering from either side of the door when the door is closed. To the contrary, all of the components of a hinge according to the invention are totally inaccessible and concealed from view when the door is closed.

Still another object of the invention is to provide a door hinge which does not present a discolored or degraded appearance when the door is closed. Unlike conventional door hinges, the hinge mechanism of the invention is totally concealed from view when the door is closed so that even if some of the components have rusted to some extent, the rust or rust stains will not be visible at all except when the door is opened.

In one broad aspect the present invention may be considered to be a hidden hinge mechanism for guiding a moveable member in rotation relative to a stationary member about a straight, linear axis of rotation that extends parallel to both the movable member and the stationary member. The movable member and the stationary member have planar, mounting surfaces that reside in mutually facing, parallel relationship when the movable member is closed relative to the stationary member.

The hinge mechanism is comprised of a mounting body barrel that is recessed into the movable member from the mounting surface thereof and another mounting body barrel that is recessed into the stationary member from the mounting surfaces. The barrels each define therewithin an arcuately curved cavity, the curvature of which is centered about the axis of rotation of the movable member relative to the stationary member. A pair of hollow sleeves, curved to conform to the curvature of the cavities are provided. These sleeves are movable reciprocally within the cavities between withdrawn positions retracted completely within the cavities and extended positions projecting toward each other from the mounting surfaces. The hinge mechanism also includes a slide curved to conform to the curvature of the sleeves and movable telescopically therewithin between a withdrawn position encapsulated within the sleeves and an extended position extending between the sleeves.

In another aspect the invention may be considered to be a hidden hinge mechanism for mounting a door member relative to a jamb member, wherein the door member and the jamb member have planar mounting surfaces that are in mutually facing juxtaposition when the door member is closed relative to the jamb member. The door member and the jamb member lie at an obtuse angle with respect to each other and relative to an axis of rotation that is parallel to and lies beyond both of the mounting surfaces when the door member is opened relative to the jamb member.

The hinge mechanism is comprised of body elements in both the door member and the jamb member. The body elements are recessed within the respective members and extend perpendicular to the mounting surfaces thereof. Each body element defines therewithin an arcuate cavity having a circular curvature centered on the axis of rotation. Separate hollow arcuate sleeve elements are mounted to move within the body elements in reciprocal fashion relative thereto. The sleeve elements move between extreme open positions arcuately projecting from the body elements and extreme closed positions retracted completely into the body elements. Each of the sleeve elements also has a circular curvature centered on the axis of rotation.

A slide element having opposing ends is also provided. The opposing ends of the slide element are respectively mounted to the sleeve elements in telescoping fashion and are movable relative thereto between an extreme open position withdrawn from the sleeve elements and an extreme closed position encapsulated within the sleeve elements. The slide element also has a circular curvature centered on the axis of rotation.

In still another aspect the invention may be considered to be a concealed hinge for a door that is mounted for rotation relative to an opening that has a hinge mounting jamb. The door and the jamb both have mounting surfaces that reside in mutually facing juxtaposition when the door is closed in the opening. The hinge is comprised of at least one hinge mechanism.

Each hinge mechanism includes a pair of body elements, wherein one body element in each pair extends into the door perpendicular to the mounting surface thereof. Another body element in each pair extends into the jamb perpendicular to the mounting surface thereof. The body elements both define arcuate cavities therewithin formed with a circular, arcuate center of curvature relative to an axis of rotation that is parallel to and located externally of the mounting surfaces of the door and the jamb.

A pair of hollow, arcuate sleeves are provided, each having the same center of curvature as the arcuate cavities. Each sleeve has an exterior end and an interior end. Each arcuate sleeve is mounted for reciprocal movement relative to a different one of the arcuate cavities and is limited to travel between an extreme closed position in which the sleeve resides entirely within its arcuate cavity and an extreme opened position in which the exterior end of each sleeve projects outwardly from its arcuate cavity. An arcuate slide is provided having opposing ends and the same center of curvature as the sleeve. The arcuate slide is telescopically mounted relative to both of the sleeves for reciprocal movement relative thereto. The slide moves between an extreme closed position in which one-half the length of the slide is received telescopically within the hollow confines of each of the sleeves, and an extreme open position in which only its opposing ends remain within the sleeves.

While a hinge may be comprised of a single hinge mechanism of the type described, preferably the hinge is formed of a plurality of hinge mechanisms of this type which are mounted on a single, flat door mounting plate and a single, flat jamb mounting plate. All of the body elements of the hinge mechanisms that extend into the door are rigidly secured to the single door mounting plate. All of the body elements that extend into the jamb are rigidly secured to the single jamb mounting plate. Preferably also, each of the body elements has a cylindrical outer surface.

The invention may be described with greater clarity and particularity by reference to the accompanying drawings.

DESCRIPTION OF THE EMBODIMENT

Figure 1:
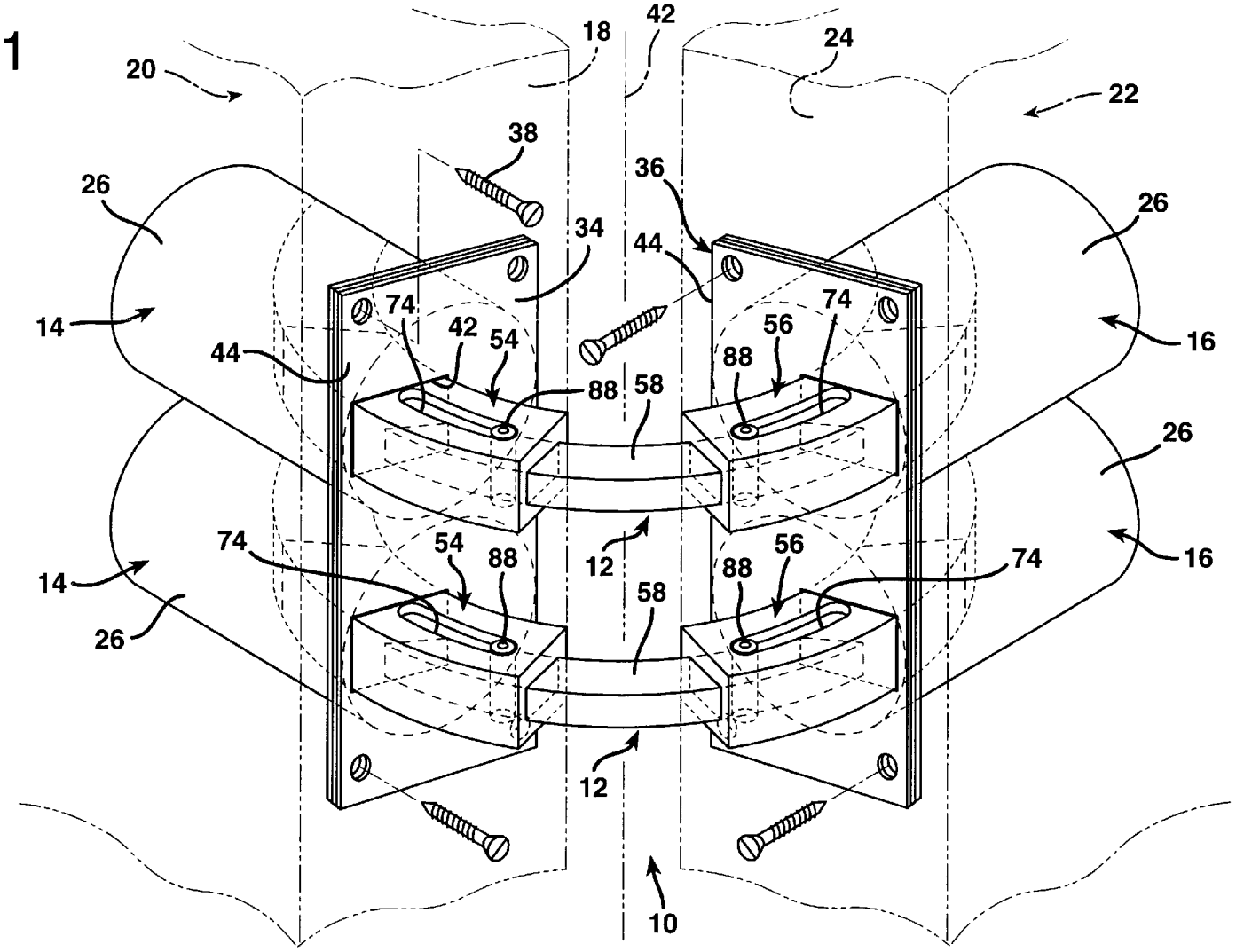
FIG. 1 is a perspective view illustrating a hinge constructed according to the invention in an open condition.

FIGS. 1 through 4 illustrate a door hinge assembly in solid lines indicated generally at 10. The hinge 10 is comprised of a pair of hinge mechanisms 12, located in vertical separation one above the other. Each hinge mechanism 12 employs a pair of cylindrical, molded plastic body elements 14 and 16, a pair of sleeves 54 and 56, and a single slide 58.

The body element 14 in each pair of body elements extends into a door 20 shown in phantom, perpendicular to the flat mounting door edge surface 18 thereof. The door 20 has a standard thickness of one and three-eighths inches. The other body element 16 in each pair extends into the door frame 22, also shown in phantom, perpendicular to the flat mounting jamb surface 24 thereof.

Figure 9:
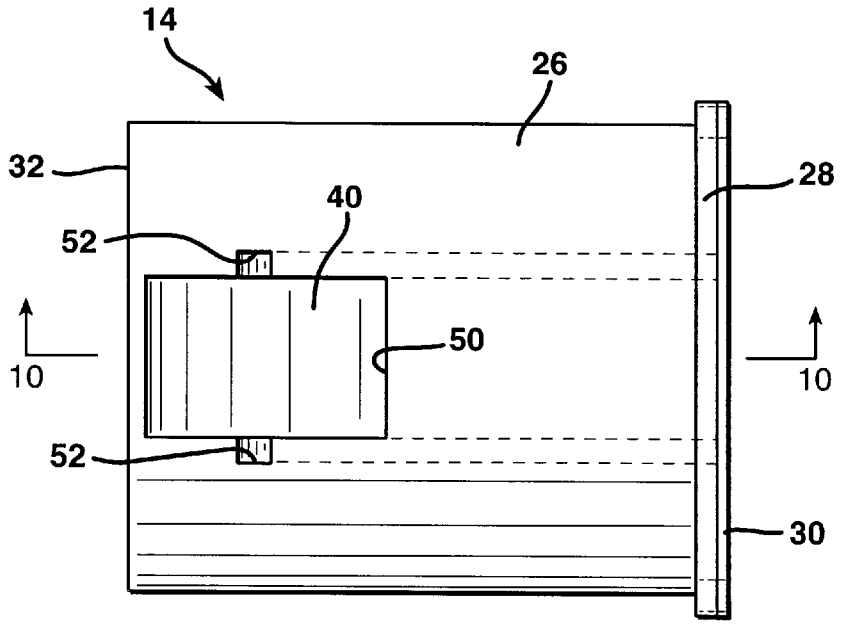
FIG. 9 is a side elevational view illustrating a single body element of the hinge of the invention shown in isolation.

As best illustrated in FIG. 9, each body element 14 and 16 has a barrel 26 with a cylindrical outer surface that is 1.1875 inches in diameter. Each body element 14 and 16 is molded with a thin, rectangular, radially outwardly directed mounting flange 28 to which a rectangular metal stiffening plate 30 is attached. The cylindrical barrel portion 26 of each body element 14 and 16 is preferably about two inches in length as measured from its inner, closed end 32 to the base of the flange 28.

The rectangular plastic flanges 28 with their rectangular metal reinforcing plates 30 are secured to the underside of the rectangular door hinge plate 34 and the rectangular frame hinge plate 36 by means of wood screws 38. That is, the first body elements 14 in the pair of hinge mechanisms 12 are secured to the undersurface of the door hinge plate 34, while the second body element 16 in each mechanism 12 is secured to the underside of the jamb hinge plate 36.

Cylindrical, blind wells are drilled into the structure of the door 20 and the structure of the frame 22 to receive each of the body elements 14 and 16. The cavities in the door and in the door frame required to receive the cylindrical surfaces of the barrels 26 of the body elements 14 and 16 may be created using a conventional lock cylinder drilling tool which cuts out a cylindrical plug of material from both the door 20 and the frame 22. The bores formed in the door 20 and the door jamb 22 are 1.25 inches in diameter and 2.0 inches in length. Thus, the cavities formed in the door 20 and the frame 22 are of a simple, cylindrical configuration and require no undercuts or other irregular cuts.

The cylindrical bores in both the door 20 and the frame 22 that respectively receive the barrels 26 of the cylindrical body elements 14 and 16 have a center-to-center vertical distance of separation of about 1.625 inches.

Figure 2:
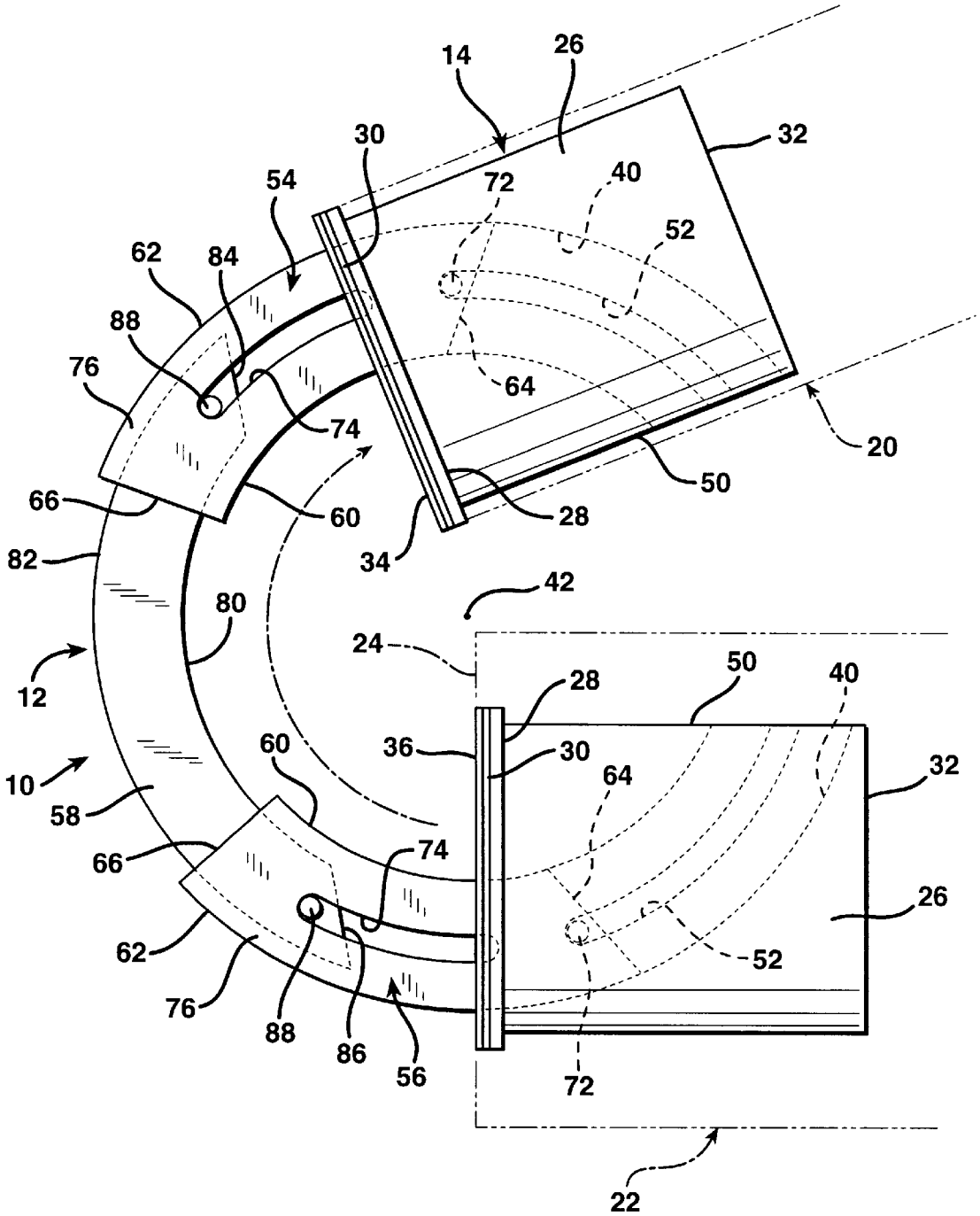
FIG. 2 is a top plan view illustrating the hinge in the position of FIG. 1.
Figure 3:
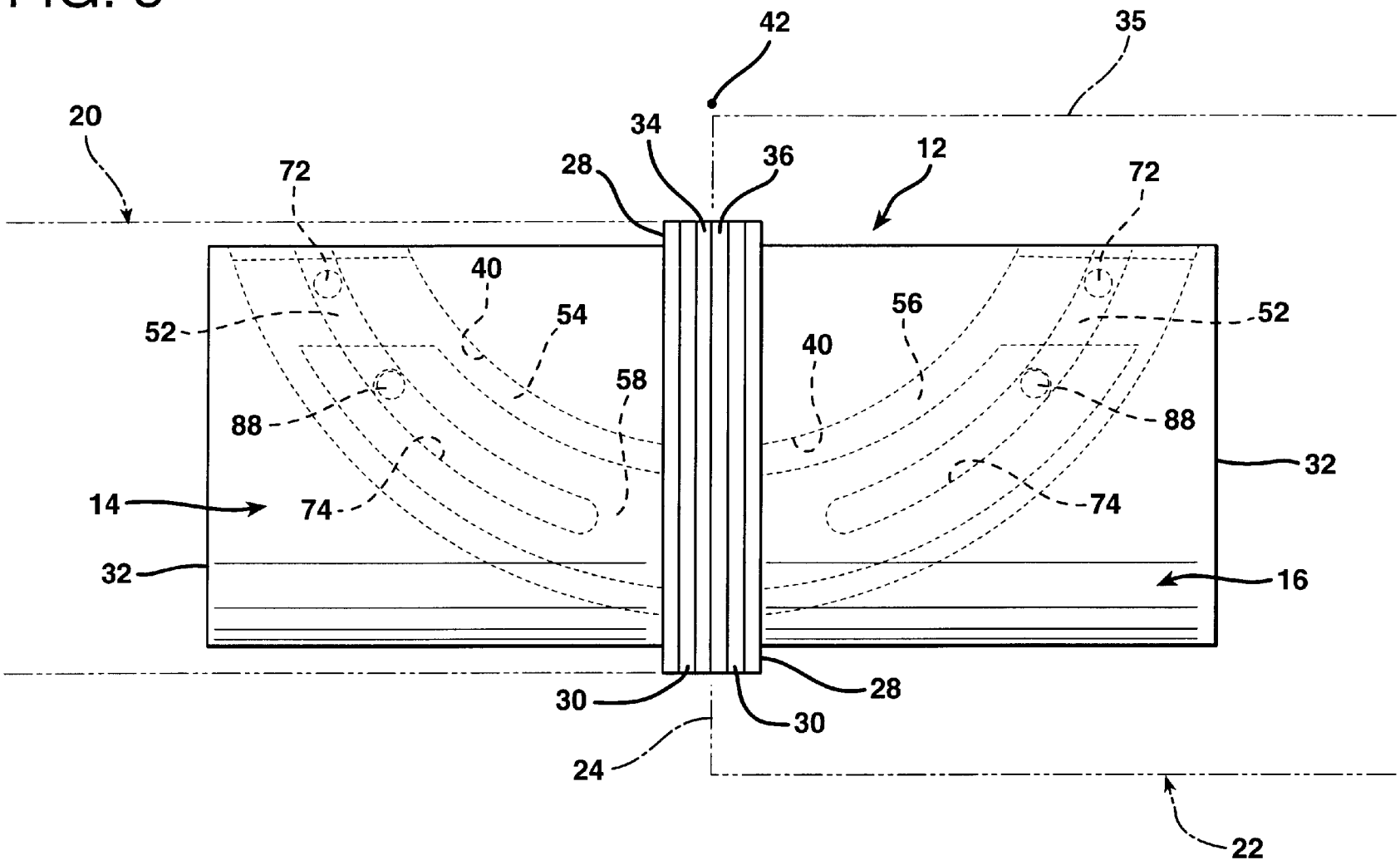
FIG. 3 is a top plan view illustrating the hinge of FIG. 1 in a fully closed position.

Each of the body elements 14 and 16 defines an arcuate cavity or tunnel 40 therewithin. Each tunnel 40 is formed with a circular, arcuate curvature centered on the axis of rotation 42 that is parallel to and lies beyond both the flat, planar door mounting edge surface 18 and the flat, planar jamb mounting edge surface 24, as best illustrated in FIGS. 2 and 3. Preferably, the axis of rotation 42 lies between about on-eighth of an inch and one inch from the outside face 35 of the door frame 22.

Figure 10:
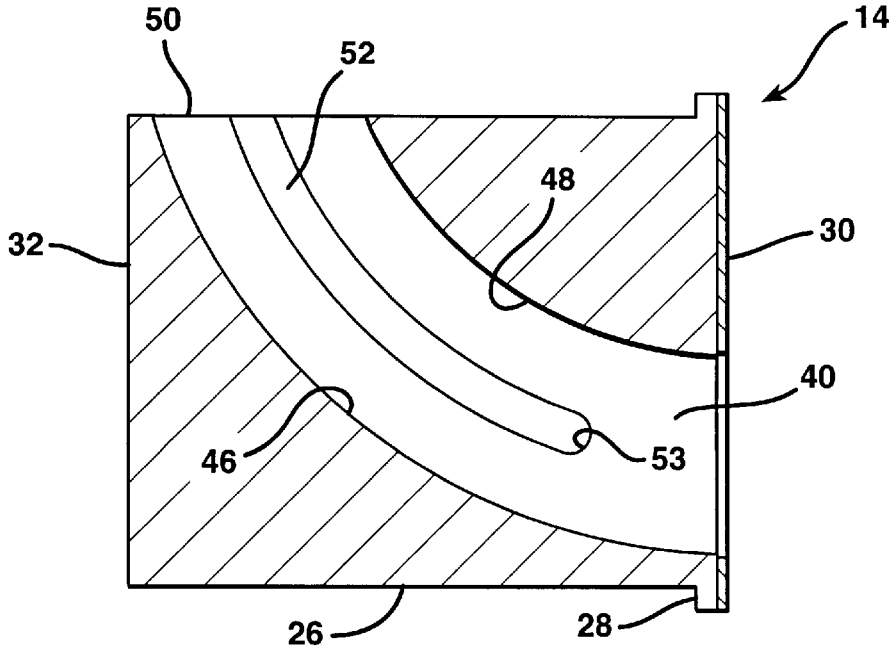
FIG. 10 is a sectional plan view taken along the lines 10—10 of FIG. 9.

A single one of the body elements 14 is illustrated in FIGS. 9 and 10. The body elements 14 and 16 are identical in construction.

As illustrated in FIG. 10, the cavity 40 extends from the flat, metal stiffening plate 30 in an arcuate curve. Each rectangular opening in each metal plate 30 is 0.600 inches wide and 0.450 inches high. Each opening in the mutually facing metal plates 30 is aligned with a corresponding, congruent opening 42 in the metal hinge plates 34 and 36. Each opening 42 is separated from the inner edge 44 of its hinge plate 34 or 36 by a narrow band of material only about 0.075 inches in width.

The cavity 40 curves arcuately through the plastic structure of the body elements 14 and 16. The radius of curvature of its outer wall 46, indicated in FIG. 10, is 1.50 inches, plus a slight clearance tolerance. The radius of curvature of the inner wall 48 of each cavity 40 is 1.0 inches, minus a slight clearance tolerance. The arcuate cavity 40 through the structure of each body element 14 and 16 extends from the rectangular opening in its metal face plate 30 to an opening 50 in the outer cylindrical wall of its barrel 26 near the closed end 32 thereof.

The body element barrels 26 are formed of solid plastic material that completely laterally surrounds the arcuately curved tunnels or cavities 40 defined therewithin. The cavities 40 extend from the body element openings adjacent the openings 42 in the hinge plates 34 and 36 near the inside edges 44 thereof to an opposite side of the cylindrical barrels 26. The arcuate cavities or tunnels 40 through the hinge barrels 26 each have a generally rectangular cross section, but also include upper and lower follower grooves 52 that extend almost, but not quite, to the cavity wall openings adjacent the openings 42 in the hinge plates 34 and 36.

The arcuately curved guide channels 52 are also centered on the axis of rotation 42. As illustrated in FIGS. 9 and 10, the guide channels 52 extend vertically upwardly and downwardly from the arcuate cavity 40 and are centered therewithin between the inner arcuate wall 48 and the outer arcuate wall 46 of the cavity 40. Each guide channel 52 extends from the opening 50 in the cylindrical surface of the barrel 26 of its body element toward the metal reinforcing plate 30, but terminates in a blind end abutment 53 at a distance of about 0.25 inches from the plate 30 within the barrel 26.

In addition to the body elements 14 and 16, each hinge mechanism 12 is provided with a pair of sleeve elements 54 and 56 and a single slide element 58. The separate, hollow, sleeve elements 54 and 56 are also of arcuate configuration having a curvature centered on the axis of door rotation 42. The sleeve elements 54 and 56 are identical in construction. A single sleeve element 54 is illustrated in isolation in FIGS. 7 and 8.

As shown in those drawing figures, each sleeve element 54 and 56 has an inner side 60 curved with a radius of curvature of 1.0 inch, plus a slight clearance tolerance, centered on the axis of rotation 42, and an outer side 62 having a radius of curvature of 1.500 inches, minus a slight clearance tolerance, likewise centered on the axis of rotation 42. The arc of curvature of both of the surfaces 60 and 62 is slightly less than 90°.

The sleeves 54 and 56 each have inner ends 64 and outer ends 66. The distance from the plane of the inner end 64 to the outside corner 68 of the outer end 66 is indicated at L1 in FIG. 7. This distance is preferably 1.200 inches. The distance from the plane of the outer end 66 of the sleeves 54 and 56 to the outside corner 70 of the inner end 64 is indicated at L2 in FIG. 7. This distance is preferably 1.500 inches.

Each sleeve 54 and 56 is formed as a hollow structure having an arcuate passage 57 of rectangular cross section defined therewithin throughout its length between the sleeve ends 64 and 66. The passage 57 has a width of 0.400 inches plus a clearance tolerance and a height of 0.250 inches plus a clearance tolerance.

Figure 7:
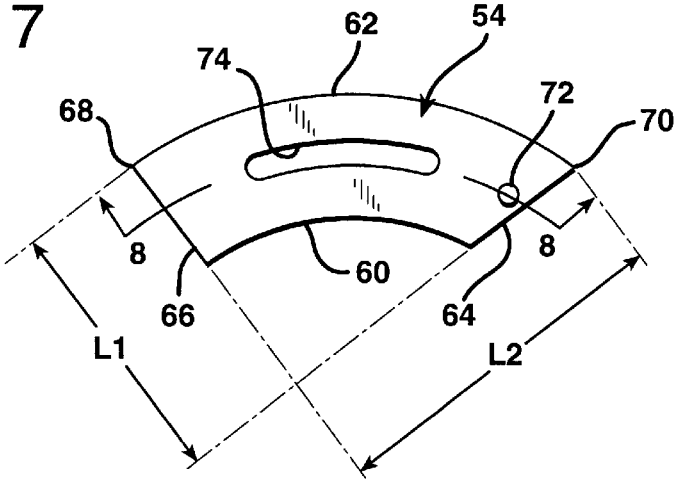
FIG. 7 is a top plan view illustrating a single sleeve element of the hinge of the invention in isolation.
Figure 8:
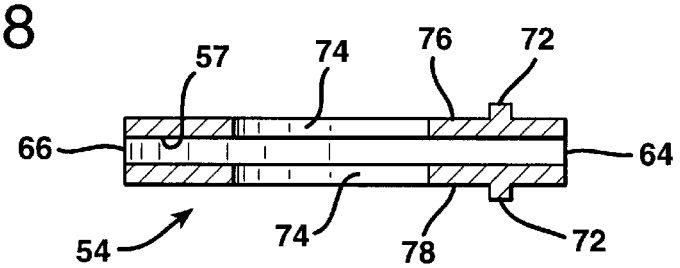
FIG. 8 is a sectional elevational view taken along the lines 8—8 of FIG. 7.

Each of the sleeves 54 and 56 is also provided with a pair of guide followers 72 that project outwardly therefrom, vertically upwardly and downwardly as illustrated in FIGS. 7 and 8. The guide followers 72 are short, cylindrical posts, preferably 0.188 inches in diameter. The guide followers 72 are located closely adjacent to the inner ends 64 of the sleeves 54 and 56. The guide followers 72 reside in the guide channels 52 and are carried into abutment against the structure of the cylindrical barrels 26 of the body elements 14 and 16 at the guide channel ends 53 proximate the door hinge mounting surface 18 and the jamb hinge mounting surface 24 when the sleeves 54 and 56 are moved to their extended positions depicted in FIGS. 1 and 2.

The sleeves 54 and 56 are also formed with a pair of elongated, arcuate slots 74 therein. The slots 74 also take the form of circular arcs having a curvature centered on the axis of rotation 42. The slots 74 are formed in both the upper surface 76 and the lower surface 78 of each of the sleeves 54 and 56. The slots 74 are preferably 0.800 inches in length and 0.135 inches in width. The slots 74 terminate a distance of 0.250 inches from the outer sleeve ends 66.

Figure 5:
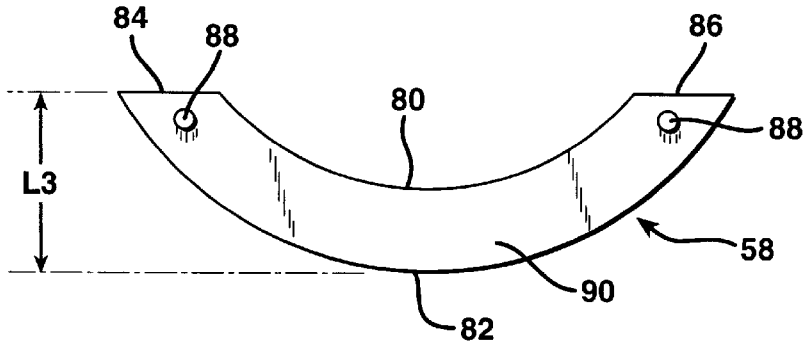
FIG. 5 is an isolated plan view of a slide employed in the hinge of FIGS. 1–4.
Figure 6:
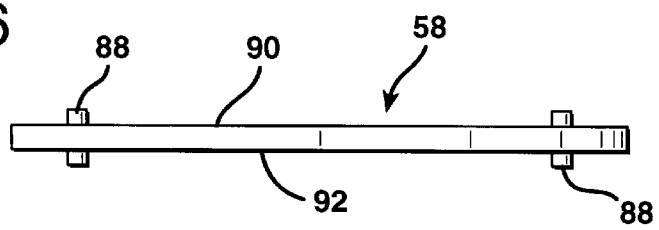
FIG. 6 is an elevational view illustrating the slide of FIG. 5 in isolation.

A single slide 58 is illustrated in isolation in FIGS. 5 and 6. Each slide 58 is curved to conform to the curvature of the passages 57 that extend through the sleeves 54 and 56 and has an inner surface 80 and an outer surface 82. The inner and outer surfaces 80 and 82 are also centered on the axis of rotation. The radius of curvature of the inner surface 80 is 1.100 inches plus a clearance tolerance while the radius of curvature of the outer surface 82 is 1.500 inches minus a clearance tolerance. The slide 58 is 0.250 inches in thickness minus a clearance tolerance.

The slide 58 has opposing ends 84 and 86 which lie in the same plane. The distance between the plane of the ends 84 and 86 and the tangent to the center of the outer arcuate surface 82 is indicated by the distance L3 and preferably is 1.100 inches.

At a distance of about 0.300 inches from each of the slide ends 84 and 86, a small, circular hole 0.125 inches in diameter is formed through the thickness of the slide 58. Short, metal rods 88 are press fit through the openings near the slide ends 84 and 86 to extend equal distances above the upper surface 90 and below the lower surface 92 of the slide 58.

The slide element 58 is a solid, plastic structure while the sleeves 54 and 56 are also formed of plastic but are hollow. The rods 88 form upper and lower slot followers at each of the slide ends 84 and 86. The slot followers formed by the rods 88 project into each of the slots 74 of the sleeves 54 and 56. The ends of the cylindrical rods 88 ride within the elongated, narrow, curved, arcuate slots 74 defined in both the upper wall 76 and the lower wall 78 of the sleeves 54 and 56. The arcuate slots 74 are closed at both ends so that the degree of movement of the slide 58 relative to the sleeves 54 and 56 is limited by interference between the ends of the rods 88 and the ends of the arcuate slots 74 in the sleeves 54 and 56. In this way relative travel of the slot followers formed by the metal rods 88 along the lengths of the slots 74 defines limits of relative movement between the slide 58 and the sleeves 54 and 56 at the withdrawn and extended positions of the slide 58, illustrated in FIGS. 4 and 2, respectively.

The hollow sleeves 54 and 56 extend over an arc of less than 90°. The mounting door edge surface 18 and the mounting jamb surface 24 are separable from contact with each other by an arc of at least 135°, and preferably an arc of at least about 158°, as illustrated in FIG. 2. That is, the surfaces 18 and 24 reside at an angle of at least about 158° relative to each other when the door 20 is fully opened relative to the frame 22, as illustrated in FIG. 2. This occurs when the door 20 is rotated away from the frame 22 about the axis of rotation 42 to a maximum position of separation therefrom.

As best illustrated in FIGS. 1 and 2, barrels 26 of the body elements 14 and 16 are located within the hollow, cylindrical bores drilled into the mounting door edge surface 18 of the door 20 and the mounting jamb surface 24 of the door frame 22. A rectangular recess is also defined in both the mounting door surface 18 and the mounting jamb surface 24 to seat the hinge plates 34 and 36 so that they are flush with the mounting door surface 18 and the mounting jamb surface 24 in which they are located. The wood screws 38 pass through the hinge plates 34 and 36 and through the aligned apertures in the underlying metal reinforcing plates 30 and the flanges 28 of the body elements 14 and 16. The barrels 26 of the body elements 14 are thereby securely held in the cylindrical wells formed to receive them in the door 20 while the barrels 26 of the body elements 16 are likewise securely anchored in the cylindrical wells formed in the frame 22 to receive them.

Figure 4:
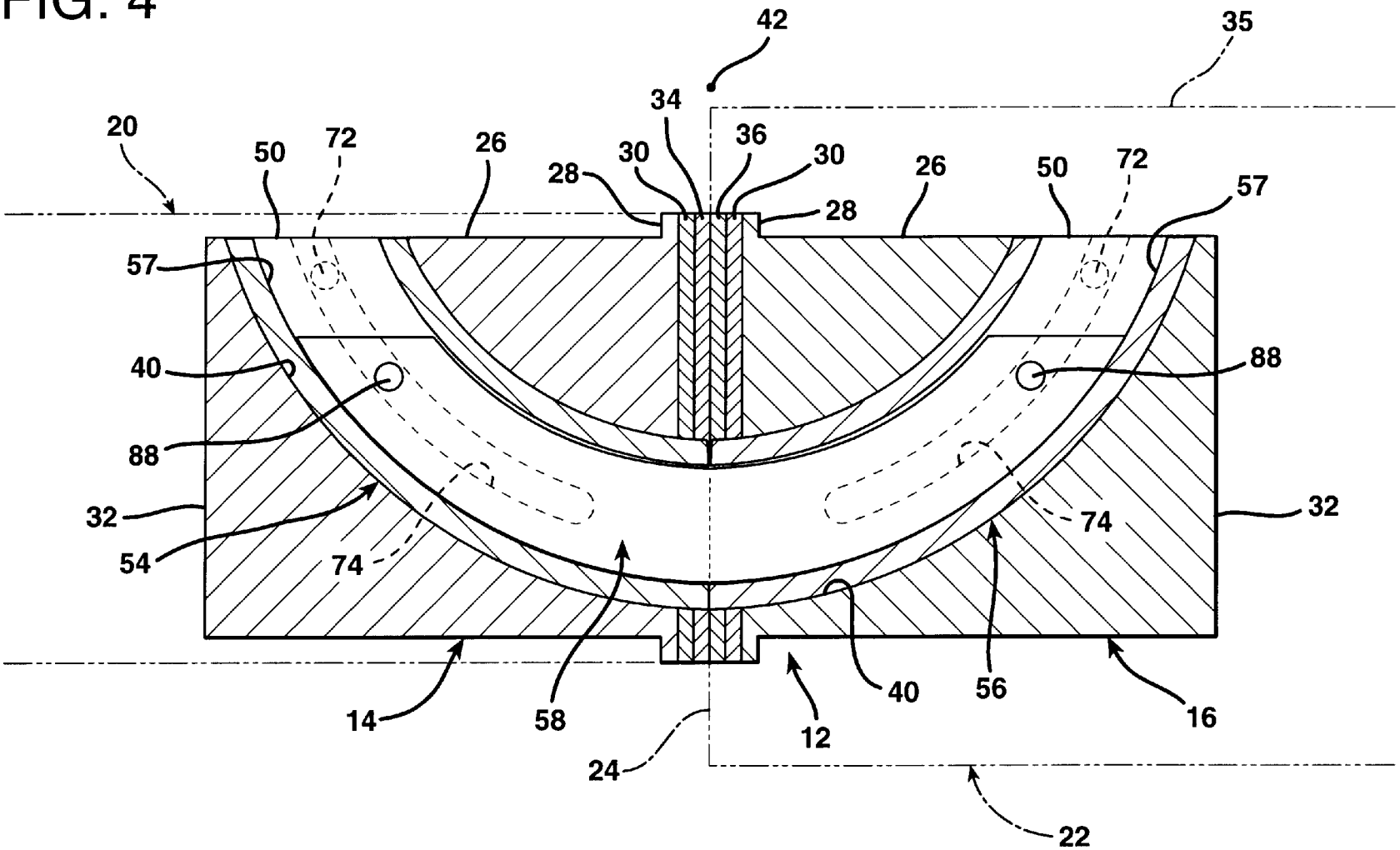
FIG. 4 is a sectional plan view illustrating a hinge mechanism in the position of FIG. 3.

The slide 58 moves telescopically within the passages 57 of the sleeves 54 and 56, which in turn move telescopically within the tunnels or cavities 40 within the barrels 26. As a result, when the door 20 is closed, as illustrated in FIGS. 3 and 4, its mounting door surface 18, beneath which the hinge barrels 14 are embedded, lies flush with the facing mounting jamb surface 24 of the door frame 22, as illustrated in FIGS. 3 and 4. When the components of the hinge mechanisms 12 are in these positions, the metal rods 88 near the ends 84 and 86 of the slide 58 are at or near the ends of the slots 74 remote from the door and frame interface formed by the juxtaposed mounting surfaces 18 and 24.

The follower posts 72 that project upwardly and downwardly from the upper surfaces 76 and the lower surfaces 78 of the sleeves 54 and 56 ride within the corresponding arcuate guide grooves 52 at the top and bottom of the centers of the cavities 40 in the hinge barrels 14 and 16. When the door 20 is closed, as depicted in FIGS. 3 and 4, the posts 72 projecting from the sleeves 54 and 56 reside at positions near the ends of the guide grooves 52 proximate the side wall openings 50 in the cylindrical hinge barrels 26. The sleeves 54 and 56 are then laterally encompassed entirely within the hinge cylinder barrels 26. On the other hand, when the door 20 is opened from the door frame 22 as depicted in FIG. 2, the slide 58 is pulled out of the sleeves 54 and 56 as far as the metal rods 88 will permit, and the follower posts 72 are likewise pulled close to the hinge plates 34 and 36 into abutment against the blind ends 53 of the guide channels 52 as far as the lengths of the grooves of the guide channels 52 will permit.

There are two telescoping actions in the structure of the hidden door hinge 10 of the invention. First, there is the telescoping action of the slide 58 within the sleeves 54 and 56. Secondly, there is the telescoping action of the sleeves 54 and 56 within the tunnels or cavities 40 in the hinge cylinder barrels 26.

The total curvature of the elements of the hinge mechanisms 12 and the lengths of the slots 74 and guide channels 52 are such that the door 20 can be opened through an arc of rotation of at least 135°, and preferably at least about 158°. When the door 20 is closed against the frame 22, however, the mounting door edge surface 18 lies flush against the mounting jamb surface 24 and all of the components of the hinge 10 are completely hidden from view, as is evident in FIG. 3.

The unique construction of the hinge mechanism of the invention allows the door 20 to be opened completely as illustrated in FIG. 2. However, the bores into the mounting door surface 18 and the mounting frame surface 24 need be no greater than one and three-sixteenths inches. This allows the hidden hinge mechanisms 12 of the invention to be utilized in standard doors which are one and three-eighths inches in thickness. Moreover, the cavities required in the door 20 and frame 22 to receive the hinge cylinder barrels 26 are of a simple, cylindrical configuration, and require no undercuts or special tooling operations in their formation.

Undoubtedly, numerous variations and modifications of the invention will become readily apparent to those familiar with hinge construction. For example, while the hinge 10 has been depicted utilizing a pair of vertically aligned hinge mechanisms 12, a single hinge mechanism 12 can be utilized if desired. Also, three or more hinge mechanisms 12 may be employed on a single set of hinge plates 34 and 36. The configurations of the mechanisms forming the stop limits for the slide 58 and the stop limits for the sleeves 54 and 56 may also be varied. Accordingly, the invention should not be considered as limited to this specific embodiment of the invention depicted and described herein.

I claim:

1. In combination, a stationary member, a movable member and a hidden hinge mechanism for guiding said movable member in rotation relative to said stationary member about a straight, linear axis of rotation that extends parallel to both said movable member and said stationary member wherein said movable member and said stationary member both have planar mounting surfaces that reside in mutually facing, parallel relationship when said movable member is closed relative to said stationary member and blind, cylindrical bores are defined in both said stationary and movable members, said bores having openings in vertical alignment with each other at said planar mounting surfaces, and said hidden hinge mechanism comprises:

a mounting body barrel having a cylindrical outer cross section that is located in said blind cylindrical bore of said movable member recessed into said movable member from said mounting surface thereof and another mounting body barrel having a cylindrical outer cross section that is located in said blind cylindrical bore of said stationary member recessed into said stationary member from said mounting surface thereof, and wherein said barrels each define therewithin an arcuately curved cavity the curvature of which is centered about said axis of rotation, a pair of hollow sleeves curved to conform to the curvature of said cavities and mounted to said body members and movable reciprocally through said cavities thereof between withdrawn positions retracted completely within said cavities and extended positions projecting toward each other from said mounting surfaces and said sleeves and said mounting body barrels are provided with guide and guide following members and said guide members terminate in abutments which block said guide followers when said sleeves reach said extended positions to hold portions of said sleeves within said cavities, and a slide curved to conform to the curvature of said sleeves and movable telescopically therewithin between a withdrawn position encapsulated within said sleeves and an extended position extending between said sleeves and wherein said slide and said sleeves are provided with arcuate slots having closed ends and slot followers that project into said slots and are limited in movement along said slots by said closed ends thereof.

2. A combination according to claim 1 wherein said mounting body barrels have a diameter no greater than about one and one-quarter inches.

3. A combination according to claim 1 wherein said guides are guide channels formed in open communication with said arcuately curved cavities and terminating proximate said mounting surfaces, and said sleeves are each provided with at least one of said guide following members which project outwardly therefrom, and said guide following members reside in said guide channels and are carried into abutment against the structure of said barrels proximate said mounting surfaces when said sleeves are moved to their extended positions.

4. A combination according to claim 1 wherein each of said sleeves is formed with at least one of said arcuate slots therein, closed at both ends; and said slide has opposite ends and is provided with at least one of said slot followers proximate each of said ends projecting into said slots, whereby relative travel of said slot followers along the lengths of said slots defines limits of relative movement between said slide and said sleeves at said withdrawn and extended positions of said slide.

5. A combination according to claim 1 wherein said hollow sleeves extend over an arc of less than ninety degrees and said mounting surfaces of said movable members are separable from contact with each other by an arc of at least 135° when said movable members are rotated away from each other about said axis of rotation.

6. A combination according to claim 1 wherein said body barrels are formed of solid material surrounding said arcuately curved cavities therewithin.

7. In combination, a door member, a jamb member, and a hidden hinge mechanism for mounting said door member relative to said jamb member wherein said door member and said jamb member both have planar mounting surfaces that are in mutually facing juxtaposition when said door member is closed relative to said jamb member and which lie at an obtuse angle with respect to each other and relative to an axis of rotation that is parallel to and lies beyond both of said mounting surfaces when said door member is opened relative to said jamb member, and wherein blind cylindrical wells are defined in said door member and in said jamb member, and said wells have openings in said planar mounting surfaces that are vertically aligned with each other, and said hidden hinge mechanism comprises:

body elements in both said door member and said jamb member wherein said body elements are recessed from said planar mounting surfaces within said blink cylindrical wells in their respective members and extend perpendicular to said mounting surfaces thereof, and each body element has a cylindrical outer surface and defines within its structure an arcuate cavity having a circular curvature centered on said axis of rotation, separate, hollow, arcuate sleeve elements mounted to said body elements to move within said arcuate cavities of said body elements in reciprocal fashion relative thereto between extreme open positions arcuately projecting from said body elements and extreme closed positions retracted completely into said body elements and wherein each of said sleeve elements also has a circular curvature centered on said axis of rotation, and a slide element having opposing ends that are respectively mounted to said sleeve elements in telescoping fashion and movable relative thereto between an extreme open position withdrawn from said sleeve elements and an extreme closed position encapsulated within said sleeve elements, and said slide element also has a circular curvature centered on said axis of rotation.

8. A combination according to claim 7 further comprising guide lugs projecting outwardly from said sleeve elements and guide channels defined in the structure of said body elements whereby said guide lugs extend into said guide channels for travel along said guide channels, and said guide channels are arcuately curved to conform to the curvature of said arcuate cavities and reside in open communication therewith, and said guide channels terminate within said body elements to form channel end abutments located proximate said planar mounting surfaces so that said channel end abutments form limit stops for said guide lugs.

9. A combination according to claim 8 wherein said body elements are formed of solid material surrounding said arcuate cavities.

10. A combination according to claim 9 wherein said outer surfaces of said body elements have diameters of no greater than about one and three-sixteenths inches and said door member opens sufficiently relative to said frame member so that said planar mounting surfaces reside at an angle of at least 135° relative to each other.

11. A concealed hinge for a door comprising at least one hinge mechanism that includes:

a pair of body elements the outer shape of each of which is a barrel having a cylindrical wall surface bounded by a closed circular end and an opposite end parallel to said closed end, and each body element defines therewithin an arcuate cavity that extends between said opposite end thereof and said cylindrical wall surface thereof, said cavities being formed with the same circular arcuate curvature, a pair of hollow, arcuate sleeves having the same circular arcuate curvature as said cavities and each sleeve being mounted to a different one of said body members, each sleeve having an exterior and an interior end and being mounted for reciprocal movement relative to said arcuate cavity of said body member to which it is mounted and limited to travel between an extreme closed position in which each sleeve resides entirely within its arcuate cavity and an extreme opened position in which the exterior end of each sleeve projects arcuately outwardly from its arcuate cavity through said opposite end of its body member, and an arcuate slide having opposing ends and the same circular arcuate curvature as said sleeves, and said arcuate slide is telescopically mounted relative to both of said sleeves for reciprocal movement relative thereto between an extreme closed position in which one-half the length of said slide is received telescopically within each of said sleeves, and an extreme open position in which only said opposing ends of said slide remain within said sleeves.

12. A concealed hinge according to claim 11 further comprising a plurality of hinge mechanisms as aforesaid, a flat door mounting plate, a flat jamb mounting plate, and a single one of said body elements of each of said hinge mechanisms is rigidly secured perpendicular to said door mounting plate, whereby said body elements secured to said door mounting plate are oriented in mutually parallel alignment and at a spaced distance of separation from each other, and a single other of said body elements of each of said hinge mechanisms is rigidly secured perpendicular to said jamb mounting plate whereby said body elements secured to said jamb mounting plate are oriented in mutually parallel alignment and at the same spaced distance of separation from each other as said body elements that are secured to said door mounting plate.

* * * * *